US005632484A

United States Patent [19]

Lambert

[11] Patent Number: 5,632,484

[45] Date of Patent: May 27, 1997

[54] BUBBLE LEVEL DEVICE, ATTACHABLE TO THE GRIP OF A GOLF CLUB

[76] Inventor: William S. Lambert, 52 Tokalon, Metairie, La. 70001

[21] Appl. No.: 296,684

[22] Filed: Aug. 26, 1994

[51] Int. Cl.[6] ..... A63B 69/36; A63B 53/14

[52] U.S. Cl. ..... 473/241; 33/334; 33/372; 33/390

[58] Field of Search ..... 273/35 R, 187.4, 273/187.5, 191 R, 192, 163 A, 164.1, 164.2, 162 B, 81 D, 165, 32 B; 248/180; 33/334, 370, 371, 372, 373, 384, 385, 386, 390

[56] References Cited

U.S. PATENT DOCUMENTS

| | | | |
|---|---|---|---|
| 3,242,582 | 3/1966 | Garrett | 273/162 B |
| 3,306,618 | 2/1967 | Liljequist | 273/162 B |
| 3,429,576 | 2/1969 | Ikeda | 273/162 B |
| 4,079,520 | 3/1978 | Davis | 273/162 B |
| 4,482,155 | 11/1984 | Higley | 273/187.4 |
| 5,174,572 | 12/1992 | Ho | 273/162 B |

*Primary Examiner*—William M. Pierce

[57] ABSTRACT

A referenced, liquid-filled, domed vial, attachable to the free-end of a golf club shaft as indicative of a selected postural shaft angle, offset from the perpendicular.

4 Claims, 2 Drawing Sheets

BUBBLE LEVEL DEVICE, ATTACHABLE TO THE GRIP OF A GOLF CLUB

BACKGROUND OF THE INVENTION

Field of the Invention

The crowded-field of accessories incidental to the typical golf club.

SUMMARY OF THE INVENTION

The game of golf might be described as energy measurably transferred to a golf ball, as projected to produce a horizontal and vertical result of the ball. Technically, gravity is a golfers' singular, immediate reference to the vertical when addressing a golf ball. Conditioned "Plumbing-Up" is currently effected per "Eye Drills" that are a repetitive, practiced and mental retention of the visual trajectory of a "free-dropped" golf ball. Self-confidence sometimes disappears during "squaring-up" to "address-the-ball"—i.e., stance, face-sole/shaft-angle/swing-plane, trajectory projection, etc.

The instant invention avails a more natural orientation to "correct" swing/plane mastery. As a training aid, the instant invention serves to assist those less-than-perfect golfers.

The instant invention is fixable to the end face of the typical hand grip of a golf club. It has a near-capacity liquid-filled, transparent dome to reference a given club-shaft/swing-plane angulation (of a driver, a putter or etc.) as so specifically offset to the vertical.

DETAILED DESCRIPTION OF THE PREFERRED EMBODIMENTS

Figure 2:
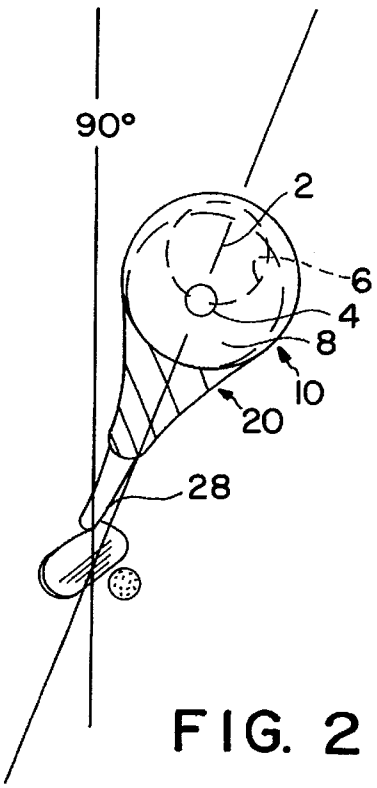
FIG. 2 suggests a correlation of a given club-shaft/swing-plane/face-sole. The index void of the liquid mass content is shown as bisected "on-point" by an angularly-referenced, horizontally-arcing, inscribement of the dome.
Figure 1:
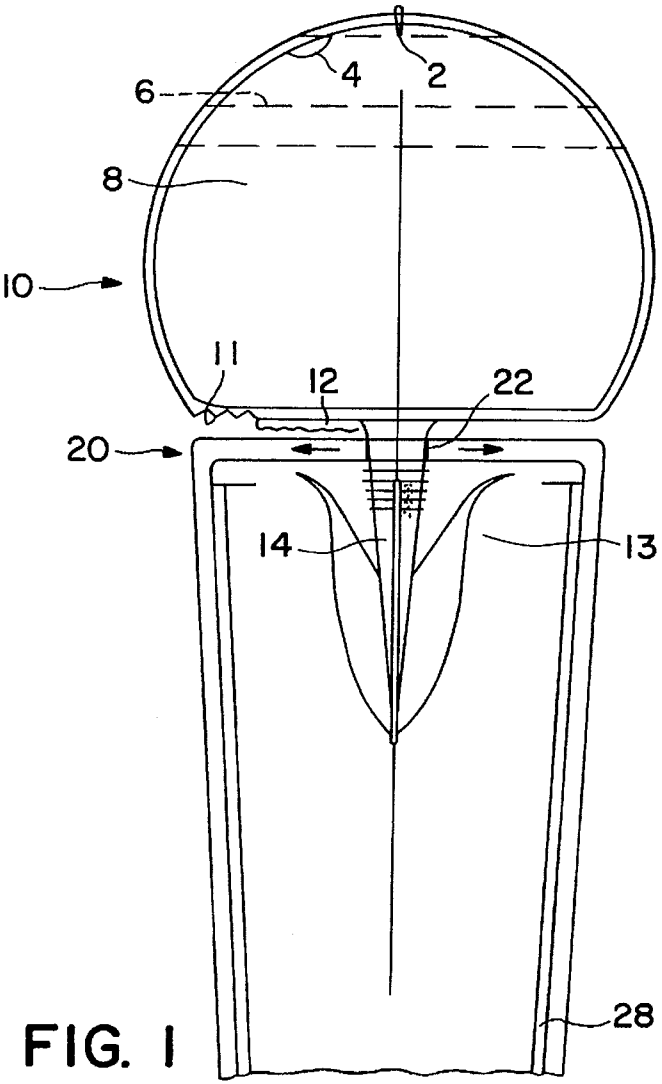
FIG. 1 depicts a sectional view of the instant invention, optionally attached per seizeably-constrictive, force-fitted, insertion into the grip end face vent aperture of a barbed stem anchor portion, formed to centrically depend from the planar undersurface of the dome floor. Selected, plural, complementary, incidental, radially-projected, frictional enhancement appurtenances are optional to augment seizure of the stem. Alternate securement is per complementary adhesion of dome underside to hand grip end face.
Figure 3B:
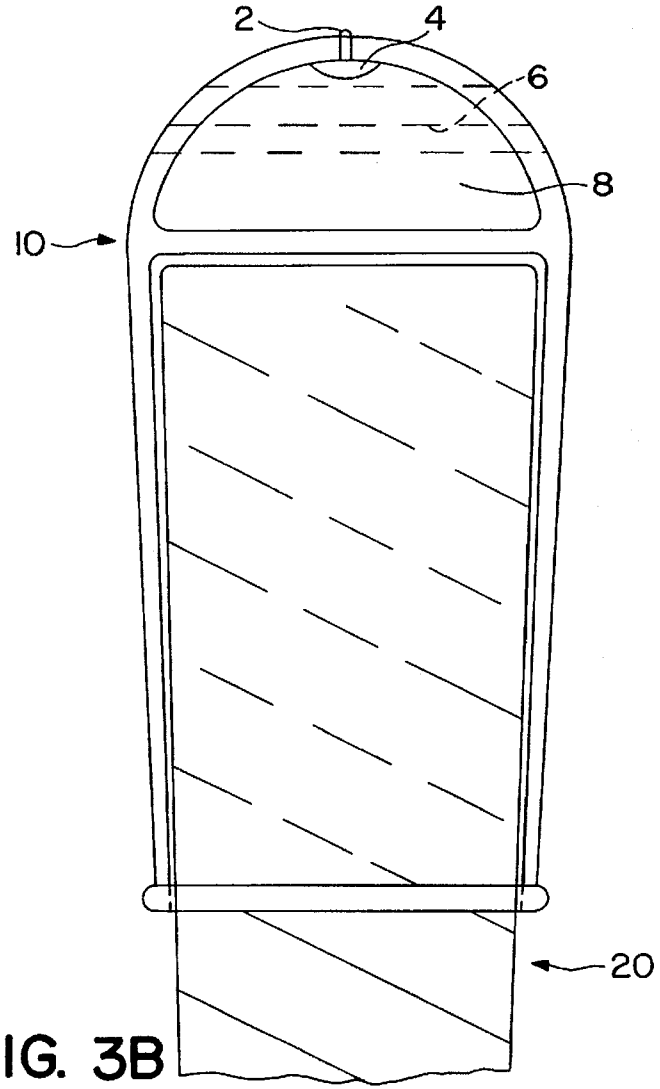
FIG. 3 departs the description of FIG. 1 only as practically altered to accommodate sleeved attachment to the atypical hand grip. With the device seated, the sleeve is constrictively rolled down into place.
Figure 3A:
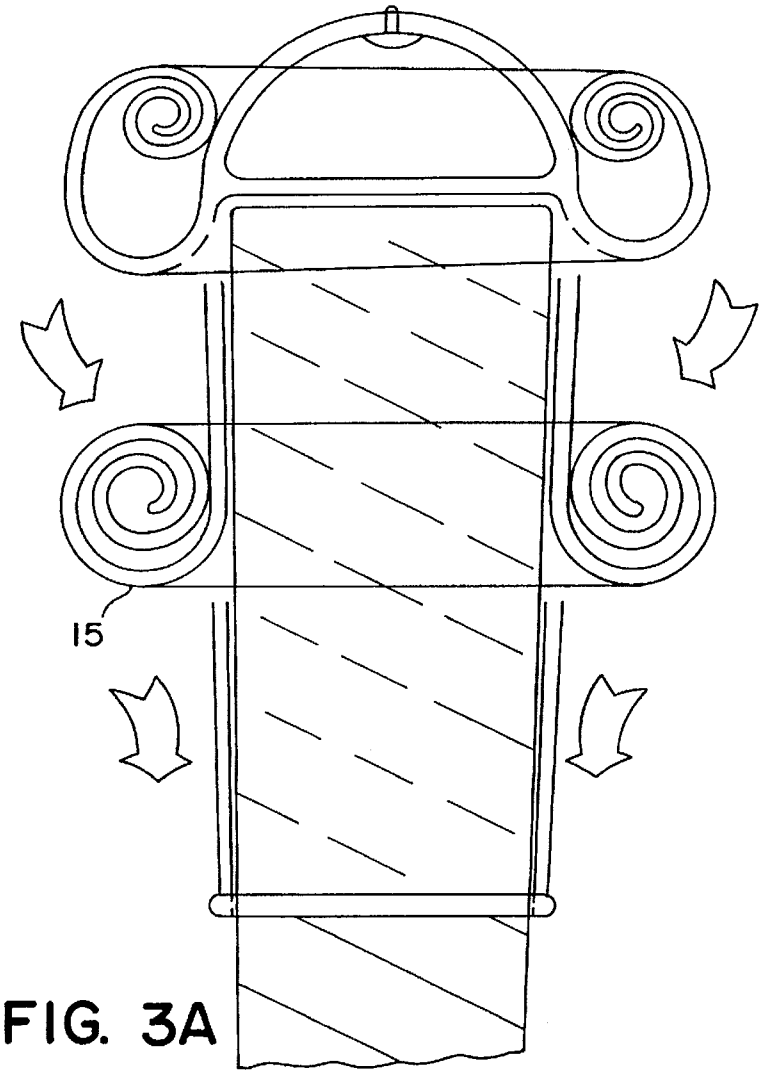

Sized-to-function, a domed vial 10, filled near-capacity with complementary liquid 8 and made of a rugged, clear, scratch-resistant, thermo/blow-formed, semi-elastic poly plastic. The underside of its floor is optionally deformable to have a centrically-depending, typical barb-like 13, self-anchoring stem 14 and to be shock-resistantly, seizeably friction-fitted, snap-fastened or screwed into the end face vent aperture 22 of a typical golf club hand grip 20. Accordingly, a mounting means comprises a protruding stem 14 having at least one barb 13 with said stem projecting from a bottom surface of the dome vial 10. The stem is capable of being inserted into a vent hole 22 of handle grip 20 of a golf club such that the barb resists its removal.

Alternate attachment is per appropriate adhesion 12 directly onto the grip end face.

A typical hand grip mounting conditions might prescribe a transparent, constrictively-elastic, fixedly-seating sleeve 15 for a rolled-down encompassment of the domed vial portion and the free end of said hand grip 20 to be interlocked as one.

Once manufactured and liquid filled 8, the prescribed angular orientation (i.e., putter, driver, etc.) is referenced per a concentrically-arcing, horizontal dome inscription 6, to bisect the indexing void 4 formed within the liquid 8. Alternatively, a flourescent, buoyant matter, that is different from liquid content may be used in place of the void. A reference indicia inscribed on the dome vial whereby the index void moves freely within the liquid and can be oriented with respect to the indicia by varying the position of the golf club. Secondarily, absent such inscription, plumb/90' is coincidentally referenced per concentric circumscribement of the filler aperture 2 by index void 4.

Visual reference aside, the index void 4 within the liquid mass 8 is compressible, the liquid mass 8 is not compressible. As relates to shock absorption and simple expansion/contraction exposure, much golfing equipment is repetitively subjected to severe air cargo hold temperature, atmospheric pressure fluctuations, and typically slammed around until back-at-home.

All other appropriate procedural preparations are presumed, i.e., club selection, stance, intended trajectory, etc. Immediate to backswing, the player visually coordinates an intended swing plane angle per orientation of the indexing void 4, as-referenced 6 to the axial centerline of the shaft—all, as complementary of an optimally "correct" swing/plane angle, per a given golf shot.

Pre-swing orientation should prescribe consequence—"correct" address-of-the-ball depends to a specific shaft/angle, horizontal/vertical relationship. Club balance, as relates to handling, is unaffected by the attachment of the instant. Upon simple installation, the instant precludes years of uninstructive, frustrating miss-swings toward acclimating the self-confidence of a shaft angle/swing plane which is automatically served up by the instant invention with every stroke, as a matter of course.

Constancy is per practiced visual/sensory conditioning. Concentric circumscribement of the filler aperture by the index void of the liquid mass coincidentally describes shaft plumbness—absent any referenced inscription upon dome.

Field-use may dictate proportional adjustment of components. Per the claims appended, alternate applications may be conceived. Eventually, for example, micro-chip technology might beep/flash this same information.

I claim:

1. The combination of a vertical reference device and a golf club of the type having a rubber handle grip with a vent hole extending through on an end thereof, said vertical reference device being attachable to the vent hole of the handle grip of the club and further comprising:

a transparent dome vial filled near capacity with a liquid such that an index void is formed within the liquid;

reference indicia inscribed on the dome vial whereby the index moves freely within the liquid and can be orientated with respect to the indicia by varying the position of the golf club; and a mounting means comprising a protruding stem having at least one barb, said stem projecting at a bottom surface of the dome vial;

whereby the stem is inserted into the vent hole of the handle grip of the golf club such that the barb resists its removal.

2. A vertical reference device as set forth in claim 1, wherein said index void is fluorescent buoyant matter different from said liquid.

3. A vertical reference device attachable to the hand grip of a golf club comprising:

a transparent dome vial filled near capacity with a liquid such that an index void is formed within the liquid;

reference indicia inscribed on the dome vial whereby the index void moves freely within the liquid and can be oriented with respect to the indicia by varying the position of the golf club; and a mounting means comprising an transparent elastic sleeve, said sleeve can be stretched over the dome vial;

whereby a bottom surface of the vial is capable of being placed in contact with an end of a handle grip of a golf club such that the sleeve can be stretched over an end portion of the grip.

4. A vertical reference device as set forth in claim 3, wherein said index void is fluorescent buoyant matter different from said liquid.

* * * * *